US010935296B2

(12) United States Patent
Saito et al.

(10) Patent No.: US 10,935,296 B2
(45) Date of Patent: Mar. 2, 2021

(54) ICE MAKING MACHINE

(71) Applicants: NIDEC SANKYO CORPORATION, Nagano (JP); WHIRLPOOL CORPORATION, Benton Harbor, MI (US)

(72) Inventors: Shunji Saito, Nagano (JP); Satoshi Tanimura, Nagano (JP); David Vega, Nuevo Leon (MX)

(73) Assignees: NIDEC SANKYO CORPORATION, Nagano (JP); WHIRLPOOL CORPORATION, Benton Harbor, MI (US)

( * ) Notice: Subject to any disclaimer, the term of this patent is extended or adjusted under 35 U.S.C. 154(b) by 156 days.

(21) Appl. No.: 16/145,784

(22) Filed: Sep. 28, 2018

(65) Prior Publication Data

US 2019/0093936 A1 Mar. 28, 2019

Related U.S. Application Data

(60) Provisional application No. 62/564,739, filed on Sep. 28, 2017.

(51) Int. Cl.
*F25C 1/10* (2006.01)
*F25C 5/187* (2018.01)
(Continued)

(52) U.S. Cl.
CPC ..... *F25C 5/187* (2013.01); *F25C 1/04* (2013.01); *F25C 1/10* (2013.01); *F25C 1/243* (2013.01);
(Continued)

(58) Field of Classification Search
CPC .... F25C 5/187; F25C 5/22; F25C 1/01; F25C 1/10; F25C 1/08; F25C 1/25
See application file for complete search history.

(56) References Cited

U.S. PATENT DOCUMENTS 5,881,558 A 3/1999 Kawahara et al.
6,732,537 B1 5/2004 Anell et al.
(Continued)

FOREIGN PATENT DOCUMENTS

JP H08261627 A 10/1996
JP 2004271047 A 9/2004

OTHER PUBLICATIONS

USPTO Non-Final Office Action for corresponding U.S. Appl. No. 16/145,810 dated May 13, 2020.
(Continued)

*Primary Examiner* — Elizabeth J Martin
*Assistant Examiner* — Nael N Babaa
(74) *Attorney, Agent, or Firm* — Cantor Colburn LLP

(57) ABSTRACT

An ice making machine may include an ice tray, a drive unit that turns the ice tray, a frame body supporting the ice tray and the drive unit, a cold air guide part integrally formed with the frame body, and a cold air duct connecting an opening in the frame body with a cold air supply port. The frame body includes a wall part at an end of the ice tray, the wall part is formed with the opening and the cold air guide part, and the cold air guide part flows cold air through the opening toward the ice tray. The cold air guide part is a frame body side inclined wall and the cold air duct includes a duct side inclined wall facing the frame body side inclined wall and a cold air blowing outlet includes the frame body side inclined wall and the duct side inclined wall.

21 Claims, 8 Drawing Sheets

(51) Int. Cl.

| | |
|---|---|
| ***F25D 17/06*** | (2006.01) |
| ***F25C 1/243*** | (2018.01) |
| ***F25C 5/20*** | (2018.01) |
| ***F25D 29/00*** | (2006.01) |
| ***F25C 1/04*** | (2018.01) |

(52) U.S. Cl.

CPC ..... *F25C 5/22* (2018.01); *F25D 17/06* (2013.01); *F25D 17/065* (2013.01); *F25D 17/067* (2013.01); *F25D 29/005* (2013.01); *F25B 2600/112* (2013.01); *F25C 2305/022* (2013.01); *F25C 2400/10* (2013.01); *F25D 2317/061* (2013.01); *F25D 2317/063* (2013.01); *F25D 2317/0672* (2013.01)

(56) References Cited

U.S. PATENT DOCUMENTS

| | | | | |
|---|---|---|---|---|
| 7,762,092 | B2 † | 7/2010 | Tikhonov | |
| 8,820,108 | B2 † | 9/2014 | Oh | |
| 2011/0146312 | A1 * | 6/2011 | Hong | F25C 5/182 62/137 |
| 2016/0258664 | A1 | 9/2016 | Visin et al. | |
| 2017/0307270 | A1 * | 10/2017 | Kim | F25C 1/24 |
| 2018/0224184 | A1 * | 8/2018 | Mitchell | F25C 1/24 |
| 2019/0086134 | A1 * | 3/2019 | Lee | F25C 5/24 |

OTHER PUBLICATIONS

USPTO Non-Final Office Action for corresponding U.S. Appl. No. 16/145,765 dated Jun. 1, 2020.

* cited by examiner
† cited by third party

ICE MAKING MACHINE

CROSS REFERENCE TO RELATED APPLICATION

The present application claims priority under 35 U.S.C § 119(e) to U.S. provisional application 62/564,739 filed Sep. 28, 2017 the entire content of which is also incorporated herein by reference.

FIELD OF THE INVENTION

At least an embodiment of the present invention may relate to an ice making machine which is structured to blow cold air to an ice tray to make ice.

BACKGROUND

A freezer or a refrigerator having a refrigerating chamber and a freezing chamber is sometimes mounted with an automatic ice making machine in which ice is made and the ice is supplied to an ice storage container provided in an inside of the freezer or the refrigerator. The ice making machine is disposed in an ice making chamber provided in a freezer or a refrigerator. A cold air outlet is provided in the ice making chamber and cold air is supplied to the ice making chamber through the cold air outlet. The ice making machine includes an ice tray and a water supply mechanism structured to supply water to the ice tray and the water supplied to the ice tray is frozen by cold air supplied through a cold air duct to make ice.

The ice making machine is disclosed in Japanese Patent Laid-Open No. 2004-271047 and Japanese Patent Laid-Open No. Hei 8-261627. A refrigerator disclosed in the former Patent Literature includes an ice making machine (automatic ice making device). The ice making machine is integrally formed with a cold air duct in an upper part of an ice tray. An ice making chamber is connected with a cold air passage and cold air supplied to the ice making chamber through the cold air passage is guided into a cold air duct and is flowed over the ice tray.

Further, in the latter Patent Literature, a refrigerator in which a cold air duct over an ice tray is separately provided from the ice tray is disclosed. The cold air duct is provided closely to the ice tray and thus cold air is supplied to the vicinity of a water surface of the ice tray.

In the former Patent Literature, although a cold air duct is integrally formed on an upper part of the ice tray, an air passage from a cold air passage to a cold air duct is a space between a wall partitioning the ice making chamber and the ice making machine. In this structure, when an outward shape of the ice making machine is changed or, when arrangement of the ice making machine in an inside of the ice making chamber is changed, cold air may not be effectively supplied to the cold air duct from the cold air passage.

Further, also in the latter Patent Literature, in a case that arrangement of an ice tray in an inside of the ice making chamber is changed or, in a case that a position of a cold air inlet on the refrigerator side with which a cold air duct is connected is changed, a positional relationship between the ice tray and the cold air duct is changed and thus cold air may be unable to be supplied to the vicinity of a water surface of the ice tray.

Further, in the former and latter Patent Literatures, the cold air duct provided above the ice tray regulates a flow of cold air and supplies the cold air to respective parts of the ice tray. However, the cold air duct covering the upper part of the ice tray is large and its shape is complicated. Therefore, the ice making machine becomes large and its structure is complicated.

SUMMARY

In view of the problem described above, at least an embodiment of the present invention may advantageously provide an ice making machine which is capable of effectively supplying cold air to an ice tray in a simple structure and improving ice making efficiency.

According to at least an embodiment of the present invention, there may be provided an ice making machine which is disposed in an ice making chamber provided with a cold air supply port to which cold air is supplied. The ice making machine includes an ice tray, a drive unit which is provided at one end in a longitudinal direction of the ice tray and is structured to turn the ice tray, a frame body which supports the ice tray and the drive unit, a cold air guide part which is integrally formed with the frame body, and a cold air duct structured to connect an opening formed in the frame body with the cold air supply port. The frame body is provided with a wall part which faces the drive unit at the other end in the longitudinal direction of the ice tray, the wall part is formed with the opening and the cold air guide part, and the cold air guide part is structured to flow cold air from the opening toward the ice tray.

According to at least an embodiment of the present invention, the frame body supporting the ice making machine and the cold air supply port provided in the ice making chamber are connected with each other through the cold air duct and thus cold air can be effectively supplied to an inner side of the frame body. Further, the cold air duct is connected by utilizing the wall part of the frame body and the wall part is provided with the cold air guide part and thus cold air can be supplied to the vicinity of the ice tray in a simple structure. Therefore, ice making efficiency can be enhanced. Further, the cold air is supplied from an end part in the longitudinal direction of the ice tray and thus the cold air can be effectively spread over the ice tray.

In at least an embodiment of the present invention, the cold air guide part is an inclined wall which is inclined with respect to a direction in which an ice making recessed part provided in the ice tray is opened. According to this structure, a direction in which the cold air guide part guides cold air is a direction where the cold air is obliquely blown downward toward an ice making recessed part. Therefore, ice making efficiency can be enhanced.

In at least an embodiment of the present invention, the inclined wall is a frame body side inclined wall which is connected with an edge facing an edge on a side of the ice tray in the opening. According to this structure, cold air which is flowed on a far side from the ice tray can be blown downward toward the ice tray. Therefore, the cold air can be effectively supplied to the vicinity of the ice tray. Further, in this case, it is desirable that the cold air duct is provided with a duct side inclined wall which faces the frame body side inclined wall. According to this structure, cold air is obliquely blown downward between the frame body side inclined wall and the duct side inclined wall and thus the cold air can be obliquely blown to the ice making recessed part.

In at least an embodiment of the present invention, the ice tray is provided with a plurality of the ice making recessed parts which are arranged in the longitudinal direction of the ice tray, and a tip end of the duct side inclined wall is directed to a direction of the ice making recessed part which is located at the closest position to the wall part, or to a direction between the ice making recessed part which is located at the closest position to the wall part and the wall part. According to this structure, cold air can be blown to the ice making recessed part located at the most front side viewed from the wall part side. Therefore, a flow of cold air can be made from the wall part side of the ice tray toward the drive unit side and thus the cold air can be efficiently spread over the ice making recessed parts.

In at least an embodiment of the present invention, the cold air guide part and the cold air duct structure a cold air blowing outlet for flowing the cold air toward the ice tray, and the cold air blowing outlet is located with respect to the ice tray on a side where the ice making recessed part is opened. According to this structure, the cold air blowing outlet can be disposed so as to face water in the ice making recessed part. Therefore, the cold air can be blown to the surface of the water.

In at least an embodiment of the present invention, a dimension of the cold air blowing outlet in a direction perpendicular to the longitudinal direction of the ice tray and a depth direction of the ice making recessed part is smaller than that of the frame body. According to this structure, the cold air blowing outlet can be disposed on an inner side of the frame body and thus cold air can be effectively supplied to the ice tray. Therefore, ice making efficiency can be enhanced.

In at least an embodiment of the present invention, the wall part is provided with a rib which divides the opening. According to this structure, a rectification effect is obtained by the rib and thus a flow of cold air can be stabilized. Further, a reinforcement effect by the rib is obtained and thus, even when the opening is provided, strength of the wall part is secured. Specifically, it may be structured that the frame body side inclined wall is an upper inclined wall which structures an upper side inclined wall for a cold air blowing outlet through which cold air is flowed toward the ice tray, the duct side inclined wall is a lower inclined wall which structures a lower side inclined wall for the cold air blowing outlet, the rib includes a plurality of vertical ribs which divide the opening in a width direction of the ice tray, and the cold air blowing outlet is divided in a plurality of divided openings by the upper inclined wall, the lower inclined wall and the plurality of the vertical ribs. Further, in this case, it may be structured that the vertical rib is formed in a flat plate shape extending in an upper and lower direction so as to be integrally formed and connected with the upper inclined wall, the lower inclined wall is formed with a groove and a cut-out part to which the plurality of the vertical ribs is fitted, and the plurality of the vertical ribs is fitted to the groove and the cut-out part of the lower inclined wall so that the cold air blowing outlet is divided to structure the plurality of the divided openings.

In at least an embodiment of the present invention, the wall part is provided with a holding hole which turnably holds a turning shaft protruded from the ice tray, and the rib includes a vertical rib which divides the opening in a width direction of the ice tray, a ring-shaped rib surrounding the holding hole, and a radial rib radially extended from the ring-shaped rib. According to this structure, a portion where the holding hole is provided is reinforced by the ring-shaped rib and the radial rib and a portion where the opening is provided is reinforced by the vertical rib. Therefore, strength of the wall part can be secured. Further, a rectification effect is obtained by the vertical rib and thus a flow of cold air can be stabilized.

In at least an embodiment of the present invention, the frame body is provided with an opening side end face which is abutted with a duct side end face of the cold air duct and a frame body side fixing part which is disposed on an outer peripheral side of the opening side end face, and the cold air duct is provided with a duct side fixing part which is fixed to the frame body side fixing part. According to this structure, a gap space between the cold air duct and the frame body can be reduced. Specifically, it may be structured that the cold air duct is provided with a connecting flow passage part having a lower side wall, an upper side wall and side walls which connect both ends in a width direction of the lower side wall and the upper side wall with each other, and the duct side end face is provided at a tip end of the upper side wall and the duct side fixing part is provided in a tip end portion of the upper side wall. In this case, it may be structured that the cold air guide part formed in the frame body is an upper inclined wall structuring an upper side inclined wall for a cold air blowing outlet structured to flow cold air toward the ice tray, the upper inclined wall being inclined with respect to a direction where an ice making recessed part provided in the ice tray is opened, the cold air duct is provided with a duct side inclined wall which is a lower inclined wall facing the upper inclined wall, the lower inclined wall being inclined with respect to the direction where the ice making recessed part is opened and, when the duct side fixing part is fixed to the frame body side fixing part and thereby the cold air duct is fixed to the frame body, the duct side end face is connected with the upper inclined wall, and the cold air blowing outlet is structured by the upper inclined wall and the duct side inclined wall.

In at least an embodiment of the present invention, a step part is formed in one of the duct side end face and the opening side end face, and an inversion shape to the step part is formed in the other of the duct side end face and the opening side end face. According to this structure, the step part and its inversion shape are fitted to each other and thus leakage of cold air can be suppressed in the connected portion of the cold air duct and the opening.

In at least an embodiment of the present invention, the cold air duct is provided with an overlapping part which is disposed on an inner peripheral side or an outer peripheral side of the wall part surrounding the opening and is overlapped with the wall part. According to this structure, leakage of cold air can be suppressed in the connected portion of the cold air duct and the opening.

In at least an embodiment of the present invention, the frame body side fixing part is located on an upper side in a vertical direction with respect to a center of the opening. According to this structure, the cold air duct can be fixed to the frame body at a position in a region of an upper half portion of the connected portion of the cold air duct and the opening. Therefore, even when fixing is performed at one point, the cold air duct can be stably supported.

In at least an embodiment of the present invention, the cold air duct is provided with an engaging arm part which is protruded toward the wall part, and the wall part is provided with an engaged part which is capable of engaging with an engaging pawl provided at a tip end of the engaging arm part. According to this engaging structure, the cold air duct can be easily attached to the frame body. Further, in a case that the above-mentioned engaging portion is provided, it is desirable that the frame body side fixing part is provided on an opposite side to an engaged position of the engaged part with the engaging pawl across the opening. According to this structure, the engaged portion and the fixed portion are disposed so as to interpose the opening therebetween. Therefore, when the cold air duct is turned with the engaged portion as a supporting point, the frame body side fixing part and the duct side fixing part can be abutted with each other. Accordingly, the cold air duct can be connected with the opening by a simple operation.

In at least an embodiment of the present invention, the engaged part and the engaging pawl are provided at a position separated from the opening. According to this structure, the engagement structure can be provided at a position where an air passage of the cold air duct is not affected.

In at least an embodiment of the present invention, the drive unit is structured to turn the ice tray by a predetermined angle from an ice making position, the frame body is provided with an abutting part which is abutted with a projection provided in the ice tray to apply a force in a twisting direction to the ice tray in a state that the ice tray has been turned by the predetermined angle, and each of the frame body and the cold air duct is formed with a relief part which is structured to avoid an interference with the ice tray in the state that the ice tray has been turned by the predetermined angle. According to this structure, an interference between the ice tray and the frame body can be prevented, and an interference between the cold air duct and the ice tray can be prevented.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

An ice making machine 1 in accordance with at least an embodiment of the present invention will be described below with reference to the accompanying drawings. In the present specification, three axes of "X", "Y" and "Z" are directions perpendicular to each other. One side in the "X"-axis direction is indicated as "+X", the other side is indicated as "−X", one side in the "Y"-axis direction is indicated as "+Y", the other side is indicated as "−Y", one side in the "Z"-axis direction is indicated as "+Z", and the other side is indicated as "−Z". The "−Z" direction is a lower side in a vertical direction (upper and lower direction) and the "+Z" direction is an upper side in the vertical direction.

(Ice Making Chamber)

Figure 1:
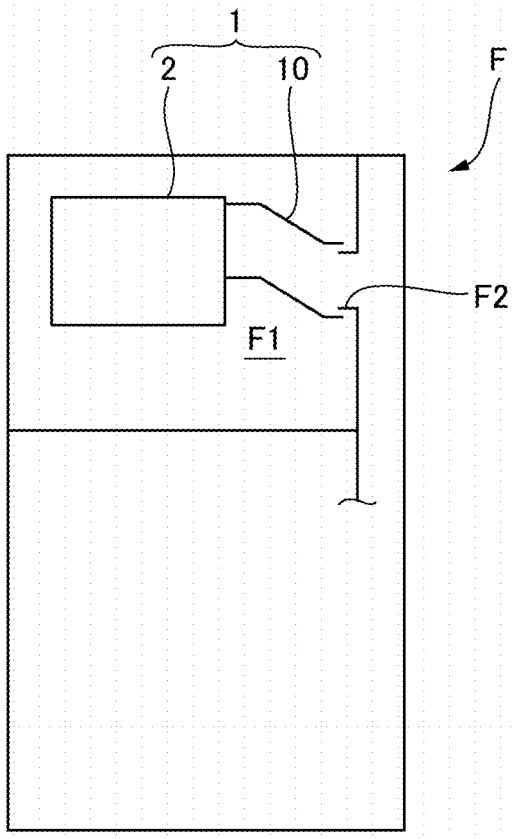
FIG. 1 is an explanatory view schematically showing a refrigerator which includes an ice making machine in accordance with an embodiment of the present invention.

FIG. 1 is an explanatory view schematically showing a refrigerator "F" which includes an ice making machine 1 to which at least an embodiment of the present invention is applied. An ice making machine 1 is arranged and used in an ice making chamber "F1" of the refrigerator "F". The refrigerator "F" includes a cold air supply part not shown for supplying cold air to the ice making chamber "F1". A cold air supply port "F2" is provided in an inside of the ice making chamber "F1", and the cold air supply port "F2" is connected with the cold air supply part. The ice making machine 1 includes an ice making machine main body 2 and a cold air duct 10. When the ice making machine 1 is to be arranged in the ice making chamber "F1", the ice making machine main body 2 and the cold air supply port "F2" are connected with each other through the cold air duct 10.

(Ice Making Machine)

Figure 2:
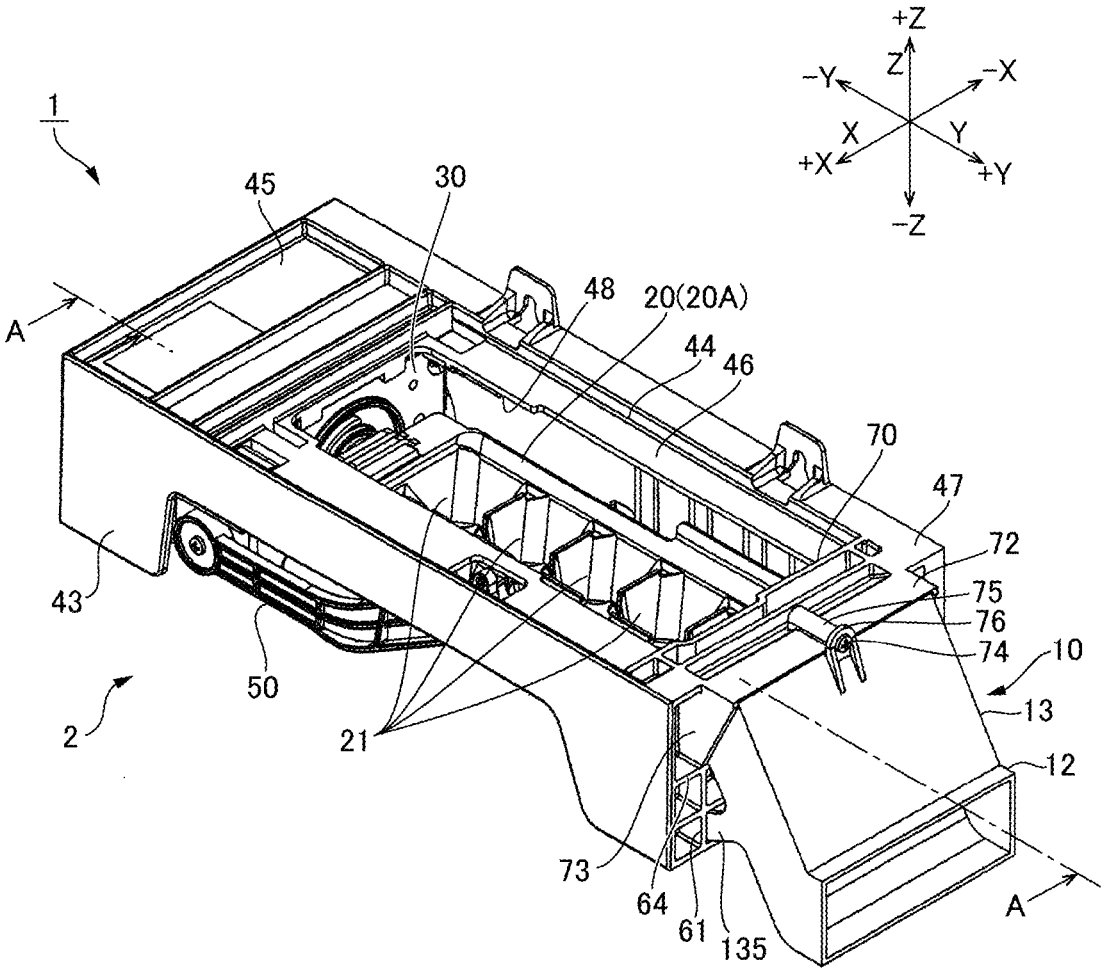
FIG. 2 is a perspective view showing an ice making machine in accordance with an embodiment of the present invention.
Figure 3:
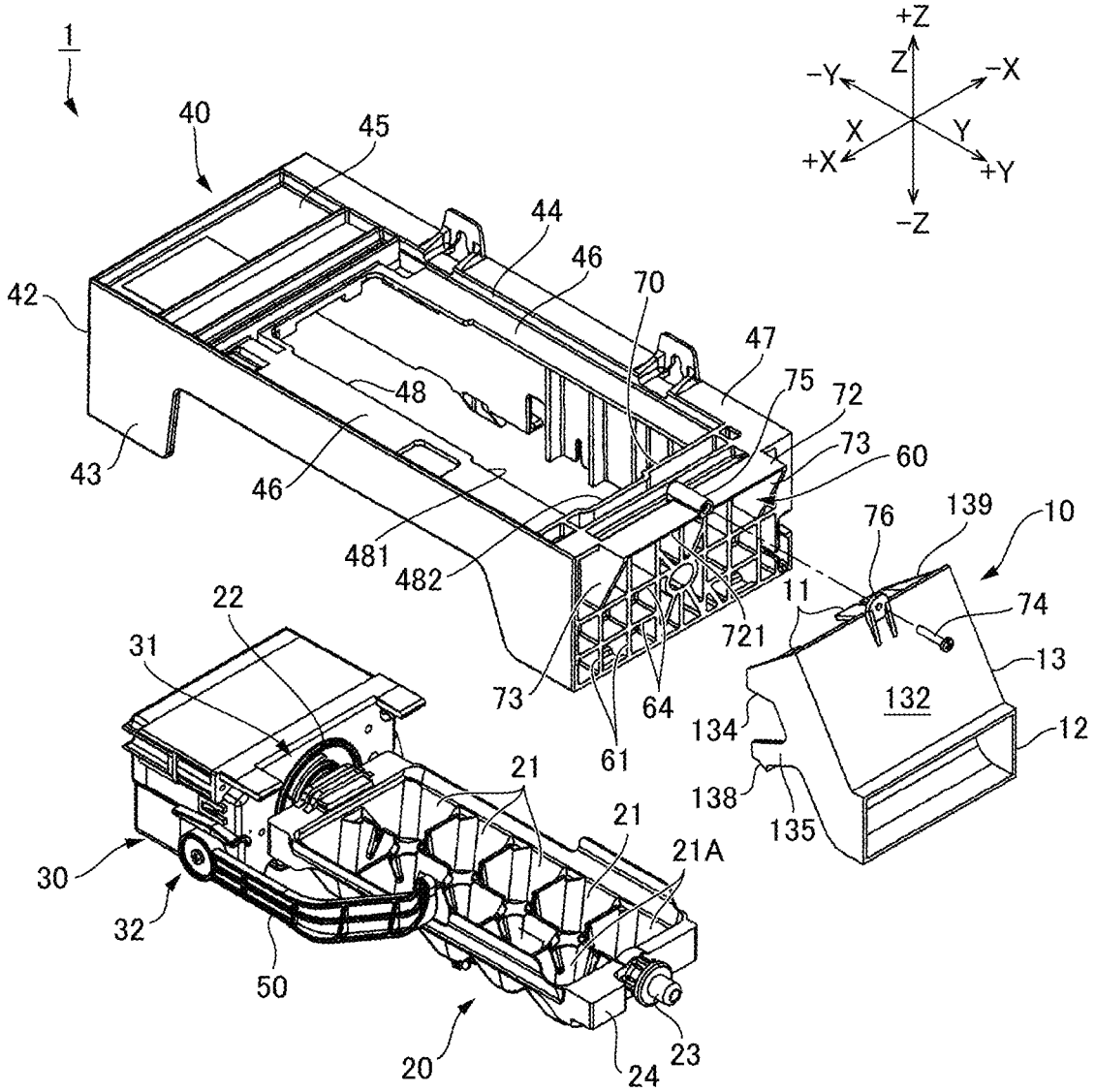
FIG. 3 is an exploded perspective view showing the ice making machine in FIG. 2.

FIG. 2 is a perspective view showing the ice making machine 1 to which at least an embodiment of the present invention is applied, and FIG. 3 is an exploded perspective view showing the ice making machine 1 in FIG. 2. The ice making machine main body 2 includes an ice tray 20, a drive unit 30 structured to turn the ice tray 20, a frame body 40 which supports the ice tray 20 and the drive unit 30, an ice storage container not shown which is disposed on a lower side ("−Z" direction) with respect to the ice tray 20, and an ice detection member 50 structured to detect an amount of ice in the ice storage container. A water supply mechanism not shown for supplying water to the ice tray 20 is disposed on an upper side ("+Z" direction side) of the ice making machine main body 2. The water supply mechanism drives a water-supply pump to supply water to the ice tray.

The ice tray 20 has a substantially rectangular planar shape and is provided with a plurality of ice making recessed parts 21. As shown in FIG. 2, the ice tray 20 is held by the frame body 40 at an ice making position 20A where the ice making recessed parts 21 face an upper side and, in this state, ice making is performed. A longitudinal direction of the ice tray 20 is coincided with the "Y"-axis direction. Further, when the ice tray 20 is located at the ice making position 20A, a short-side direction of the ice tray 20 is coincided with the "X"-axis direction. As shown in FIG. 3, a plurality of the ice making recessed parts 21 is arranged in the longitudinal direction of the ice tray 20 and is arranged in two rows in its short-side direction. The drive unit 30 is disposed on one side ("−Y" direction) in the longitudinal direction of the ice tray 20. Further, the ice detection member 50 is disposed on the "+X" direction side of the ice tray 20.

As shown in FIG. 3, the drive unit 30 includes a first drive mechanism 31 structured to turn the ice tray 20, a second drive mechanism 32 structured to turn the ice detection member 50 to a lower side, and a motor not shown which is a drive source. The drive unit 30 is structured so that the motor drives the first drive mechanism 31 and the second drive mechanism 32. The motor is a DC motor and is driven by an electric current supplied from the refrigerator "F" on which the ice making machine 1 is mounted. The ice tray 20 is provided with turning shafts 22 and 23 which are protruded from its one end and the other end in the longitudinal direction. The turning shaft 22 protruded to the drive unit 30 side ("-Y" direction side) is connected with an output shaft of the first drive mechanism 31 so as to be integrally turned together. The turning shaft 23 protruded on an opposite side to the drive unit 30 is turnably supported by the frame body 40.

The drive unit 30 is structured so that rotation of the motor is transmitted to the ice tray 20 through the first drive mechanism 31 to turn the ice tray 20. When the ice tray 20 is turned by a predetermined angle (for example, 120 degrees) from the ice making position 20A, a projection 24 formed at an end part in the longitudinal direction of the ice tray 20 is abutted with an abutting part 411 (see FIG. 5) formed in the frame body 40. When the ice tray 20 is further turned, a force in a twisting direction is applied to the ice tray 20. As a result, the ice tray 20 is twisted and deformed and ice pieces in the ice making recessed parts 21 are separated and dropped to the ice storage container. After the motor of the drive unit 30 turns the ice tray 20 by a predetermined angle (for example, 160 degrees) to separate the ice pieces, the drive unit 30 turns the ice tray 20 in a reverse direction and the ice tray 20 is returned to the ice making position 20A.

(Frame Body)

Figure 4:
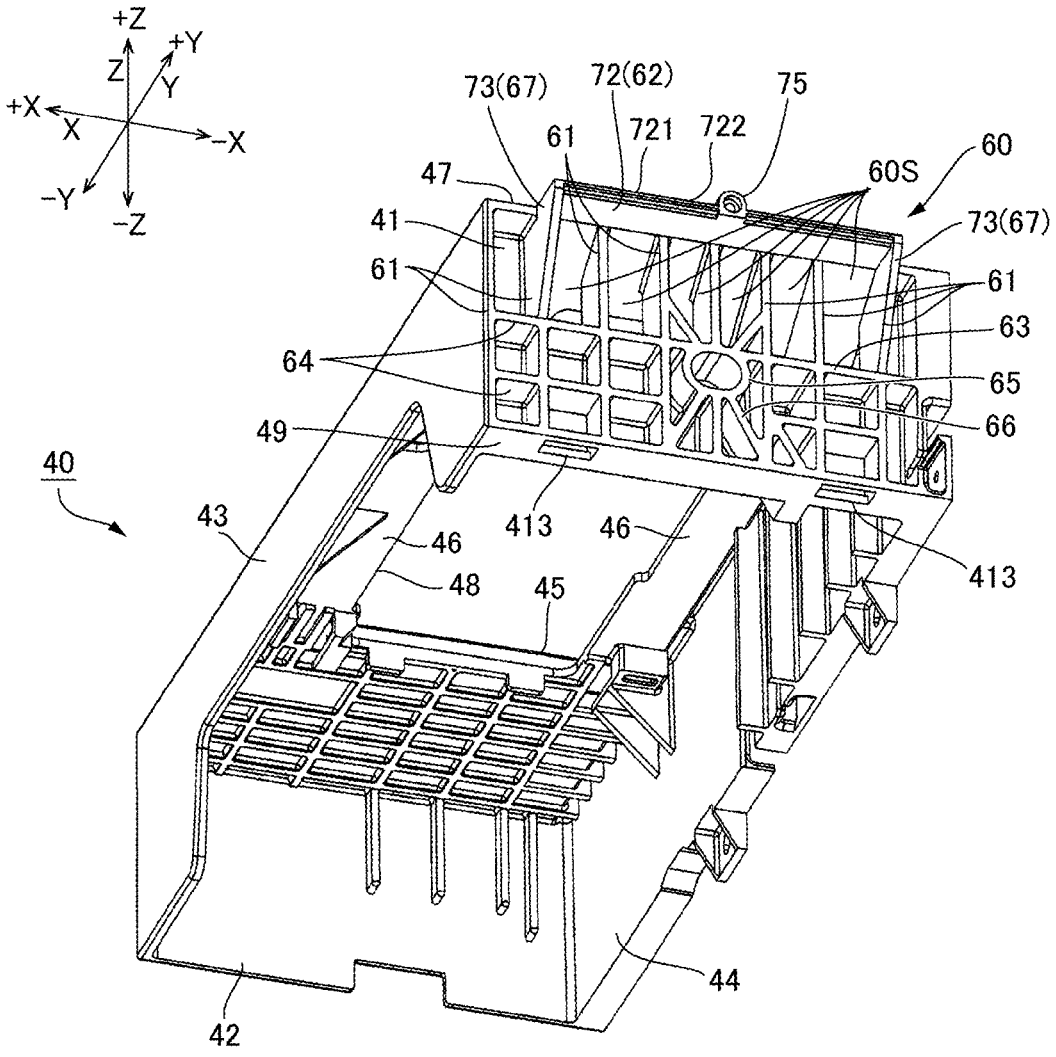
FIG. 4 is a perspective view showing a frame body which is viewed from an obliquely lower side.
Figure 5:
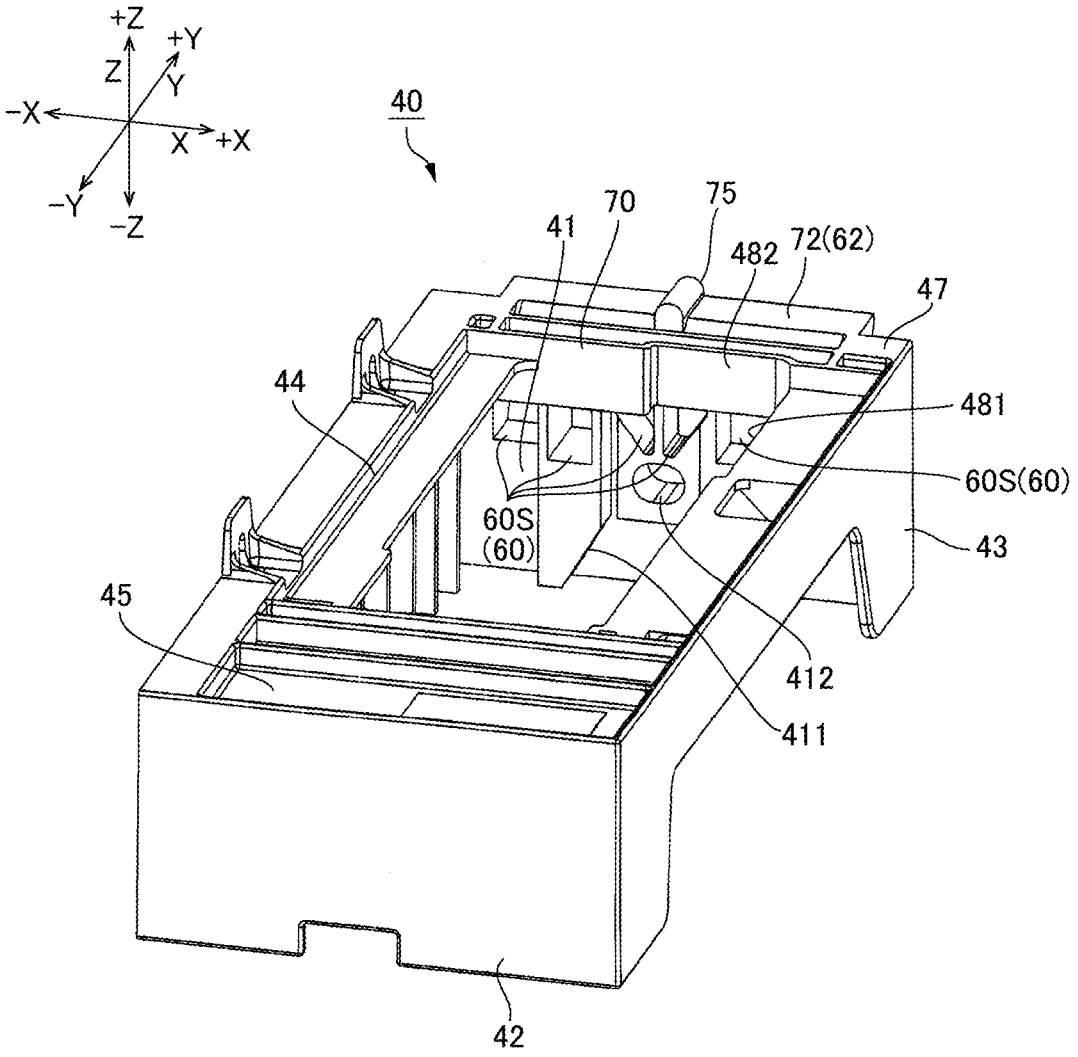
FIG. 5 is a perspective view showing the frame body which is viewed from an obliquely upper side.

FIG. 4 and FIG. 5 are perspective views showing the frame body 40. FIG. 4 is a perspective view showing the frame body 40 which is viewed from an obliquely lower side on the "+Y" direction side, and FIG. 5 is a perspective view showing the frame body 40 which is viewed from an obliquely upper side on the "−Y" direction side. The frame body 40 has a substantially rectangular planar shape and surrounds an outer peripheral side of the ice tray 20 and the drive unit 30 (see FIG. 2). The frame body 40 is provided with a wall part 41 located on the "+Y" direction side of the ice tray 20, a wall part 42 located on the "−Y" direction side of the drive unit 30, a wall part 43 located on the "+X" direction side of the ice tray 20 and the drive unit 30, and a wall part 44 located on the "−X" direction side of the ice tray 20 and the drive unit 30. As shown in FIG. 5, the wall part 41 located on the "+Y" direction side is formed with a holding hole 412 which turnably holds the turning shaft 23. Further, an inner face of the wall part 41 is provided with an abutting part 411 which is structured to abut with the projection 24 of the ice tray 20 and restrict its turning. The drive unit 30 is fixed to an inner face of the wall part 42 located on the "−Y" direction side. Therefore, the wall part 41 located on the "+Y" direction side faces the drive unit 30. The ice tray 20 is disposed between the drive unit 30 and the wall part 41.

The frame body 40 is provided with an upper plate part 45 which covers an upper part of the drive unit 30, an inside frame part 46 projecting to an inner side from upper ends of the wall parts 43 and 44, an upper frame part 47 projecting to an outer side from the wall part 41 on the "+Y" direction side and from the wall part 44 on the "−X" direction side, and a projecting part 70 which projects to an inner side from an upper part of the wall part 41 located on the "+Y" direction side. The projecting part 70 has a predetermined thickness in the "Z"-axis direction. As described below, a lower side face of the projecting part 70 (face on the "−Z" direction side) structures a frame body side inclined wall 71 which is a cold air guide part provided in the frame body 40. The frame body side inclined wall 71 is an upper inclined wall for structuring the cold air blowing outlet 14 for the ice tray 20.

The inside frame part 46 is formed in a thin plate shape and is provided at a position which is recessed to the "−Z" direction side from upper ends of the wall parts 43 and 44 and the projecting part 70. A window part 48 in a substantially rectangular shape is formed on an inner peripheral side of the inside frame part 46 and the projecting part 70. A corner part of the window part 48 which is located between the "+X" direction and the "+Y" direction is formed with relief parts (recessed parts) 481 and 482 which enlarge the opening shape by one stage to an outer side. The relief parts 481 and 482 are provided for avoiding an interference between the ice tray 20 which is deformed by being applied with a force in the twisting direction and the inside frame part 46. The relief part 481 is formed in the inside frame part 46 and the relief part 482 is formed in the projecting part 70.

As shown in FIG. 4, an opening 60 is formed in an outer side face of the wall part 41 so as to penetrate through the wall part 41. The opening 60 is divided at a constant interval in its width direction ("X"-axis direction) by a plurality of vertical ribs 61 which are extended in the "Z"-axis direction and in the "Y"-axis direction (the vertical ribs 61 are formed in a flat plate shape so as to be extended in the upper and lower direction and in the longitudinal direction of the ice tray 20). In this embodiment, the opening 60 is divided into six portions by the vertical ribs 61 and the number of divided openings 60S partitioned by the vertical ribs 61 is six (6). However, the divided number of the opening 60 by the vertical ribs 61 is not limited to six (6). An outward shape of the opening 60 is rectangular whose width direction ("X"-axis direction) is its longitudinal direction. An opening width (width in the "X"-axis direction) of the opening 60 is larger than a width in the "X"-axis direction of the ice tray 20. Further, the opening 60 is located on an upper side ("+Z" direction side) with respect to the holding hole 412 by which the turning shaft 23 of the ice tray 20 is held. In other words, the opening 60 is formed on an upper side ("+Z" direction side) with respect to a height where the ice tray 20 is disposed.

As shown in FIG. 4, the vertical ribs 61 are provided on an outer side face of the wall part 41. The upper ends of the vertical ribs 61 are connected with the upper frame part 47. Further, a lower end of the wall part 41 is formed with a lower frame part 49 which faces the upper frame part 47 in the "Z"-axis direction, and lower ends of the vertical ribs 61 are connected with the lower frame part 49. The lower frame part 49 is formed with a rectangular engaging hole 413 at two positions.

The wall part 41 is formed with eight vertical ribs 61 which are extended from the upper frame part 47 to the lower frame part 49. The vertical rib 61 located on the most "+X" direction side of the eight vertical ribs 61 is disposed at an end in the "+X" direction of the wall part 41 and is located on the same face as the wall part 43. Further, the second vertical rib 61 and the eighth vertical rib 61 from the "+X" direction side are disposed along an edge on the "+X" direction side and along an edge on the "−X" direction side of the opening 60 which is in communication with an inner side of the frame body 40 where the ice tray 20 is disposed. Therefore, a width in the "X"-axis direction of the opening 60 is smaller than a width in the "X"-axis direction of the frame body 40. Further, the third through the seventh vertical ribs 61 from the "+X" direction side divide the opening 60 so as to be divided as a plurality of the divided openings "60S" which are divided in the "X"-axis direction.

An outer side face of the wall part 41 is formed with two lateral ribs 64 which are perpendicular to the vertical ribs 61. The opening 60 is formed between the upper lateral rib 64 and the upper frame part 47 in the upper and lower direction. Further, the outer side face of the wall part 41 is formed with a ring-shaped rib 65 surrounding the holding hole 412 by which the turning shaft 23 of the ice tray 20 is held, and radial ribs 66 which are radially extended from the ring-shaped rib 65 toward an outer side in a radial direction. As shown in FIG. 4, two center divided openings 60S of the six divided openings 60S are sectioned by the radial ribs 66.

The outer side face of the wall part 41 is provided with an upper plate part 72 which is protruded in the "+Y" direction from a center portion in the "X"-axis direction of the upper frame part 47 so as to have the same width as the opening 60, and side plate parts 73 which are formed by extending the vertical ribs 61 located at both ends in the "X"-axis direction of the opening 60 to the "+Y" direction. Lower ends of the side plate parts 73 are connected with the upper lateral rib 64. The upper plate part 72, the side plate parts 73 and the upper lateral rib 64 structure a tube body having a rectangular cross section as a whole, and the tube body structures the opening 60. An upper end face 62 of the opening 60 is structured of the upper plate part 72, and a lower end face 63 of the opening 60 is structured of the upper lateral rib 64. The upper end face 62 and the lower end face 63 are extended in parallel to the "X"-axis direction and face each other with a predetermined distance. Side end faces 67 of the opening 60 is structured of the side plate parts 73. An end face in the "+Y" direction of the side plate part 73 is an inclined end face which is extended to a direction between the "+Z" direction and the "+Y" direction.

(Cold Air Duct)

Figure 6:
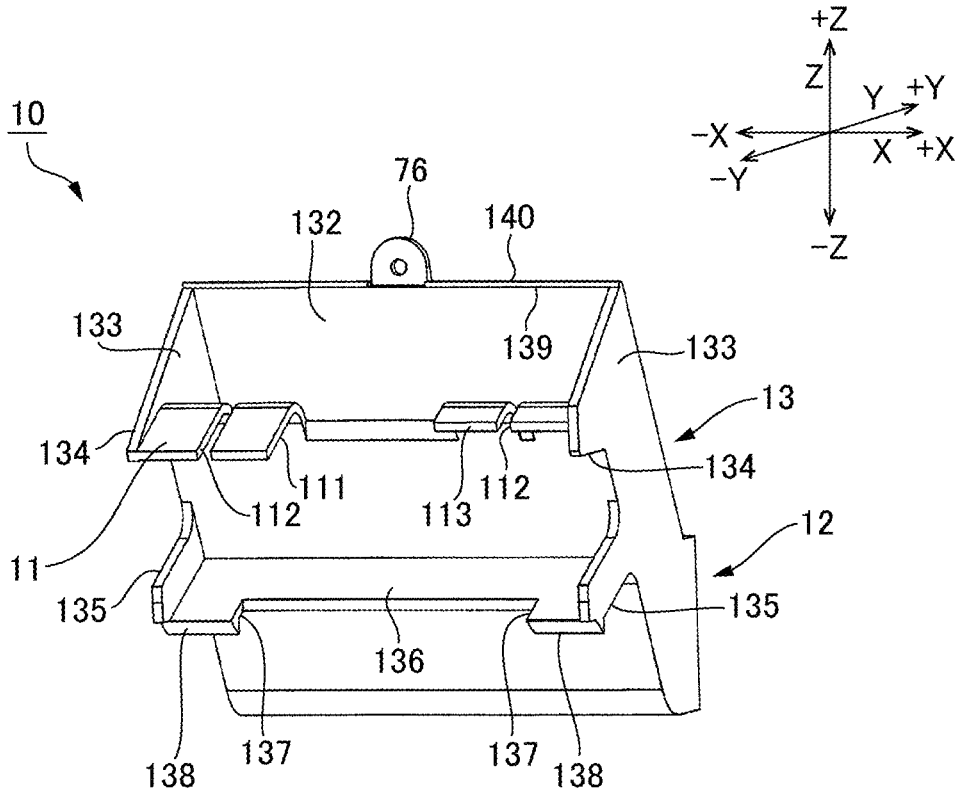
FIG. 6 is a perspective view showing a cold air duct.
Figure 7A:
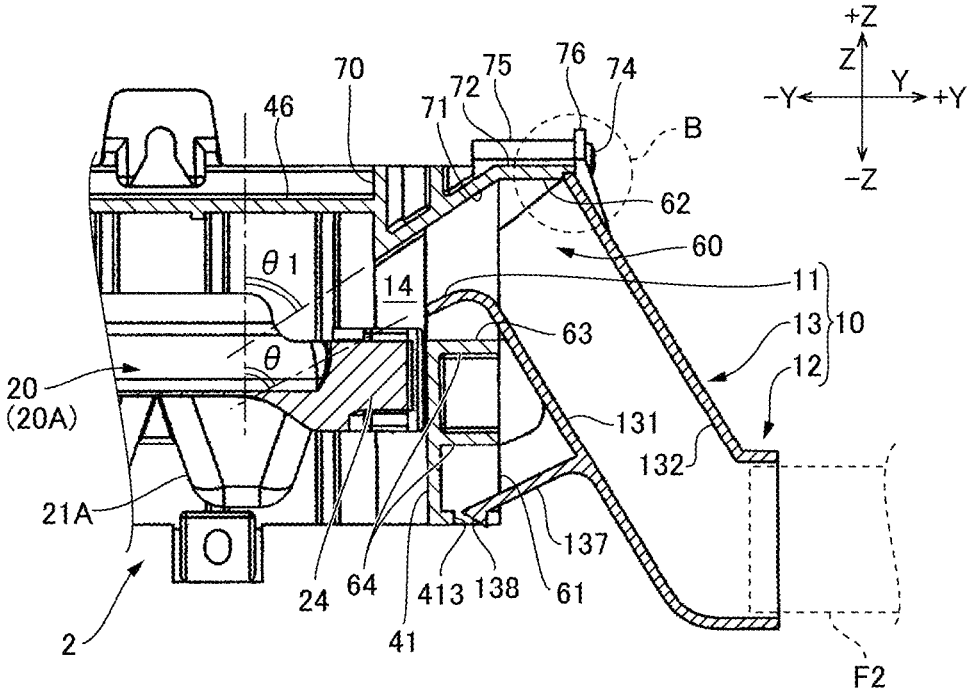
FIG. 7A and FIG. 7B are partial cross-sectional views showing the ice making machine in FIG. 2.
Figure 7B:
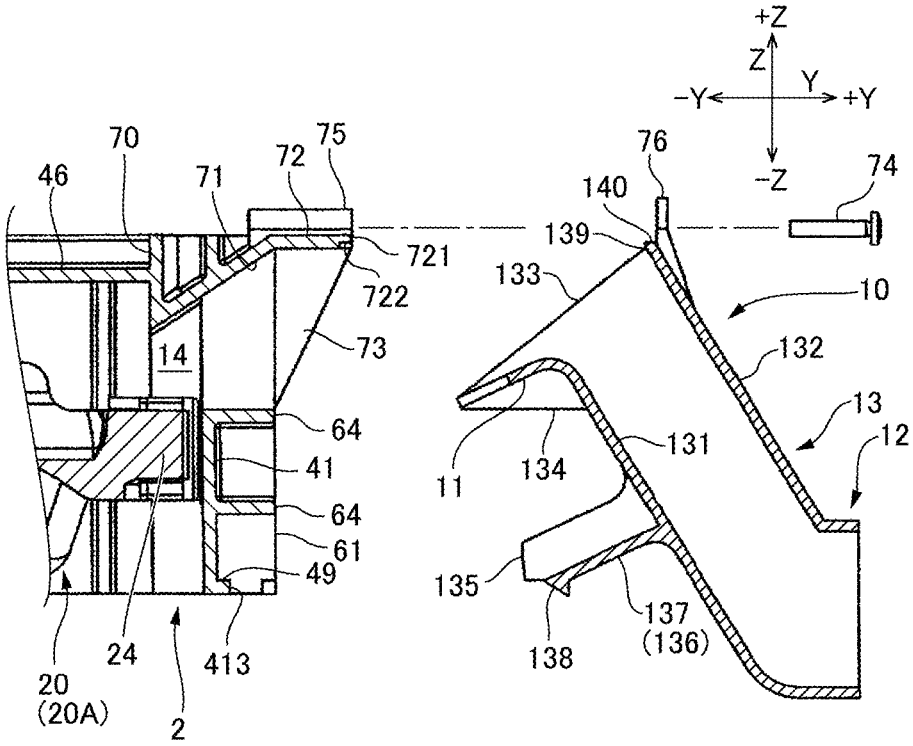

FIG. 6 is a perspective view showing a cold air duct 10 which is capable of attaching to and being detached from the ice making machine main body 2, specifically, the frame body 40 which supports the ice tray 20 and the drive unit 30, and FIG. 6 is the perspective view which is viewed in a direction between the "−Y" direction and the "+X" direction. Further, FIG. 7A and FIG. 7B are partial cross-sectional views showing the ice making machine 1 in FIG. 2 and are the partial cross-sectional views which are cut at the "A-A" position in FIG. 2. FIG. 7A shows a state that the ice making machine main body 2 and the cold air duct 10 are connected with each other, and FIG. 7B shows a state that the ice making machine main body 2 and the cold air duct 10 are separated from each other. As shown in FIG. 7A, a lower end of the projecting part 70 provided at an upper end of the wall part 41 is provided with a frame body side inclined wall 71 which is inclined downward to the "−Z" direction as going to the "−Y" direction. The frame body side inclined wall 71 is used as the upper inclined wall structuring the inclined wall on an upper side for the cold air blowing outlet 14 from which cold air is blown toward the ice tray 20. The frame body side inclined wall 71 is connected with the upper plate part 72 (upper end face 62 of the opening 60) which is provided in the outer side face of the wall part 41.

As shown in FIG. 7A, the cold air duct 10 is provided with a duct side inclined wall 11 which is inserted into the opening 60, an attaching part 12 which is connected with the cold air supply port "F2" of the ice making chamber "F1", and a connecting flow passage part 13 which connects the duct side inclined wall 11 with the attaching part 12. The duct side inclined wall 11 faces the frame body side inclined wall 71 and is inclined downward to the "−Z" direction as going to the "−Y" direction (in other words, the ice tray 20 side). The duct side inclined wall 11 structures a lower inclined wall structuring an inclined wall on a lower side for the cold air blowing outlet 14 from which the cold air is blown toward the ice tray 20.

As shown in FIG. 6, the connecting flow passage part 13 of the cold air duct 10 is formed in a tube shape having a rectangular cross section and is provided with a lower side wall 131 and an upper side wall 132 facing each other in the "Z"-axis direction and side walls 133 which connect both ends in the width direction of the lower side wall 131 and the upper side wall 132. As shown in FIG. 7A, the duct side inclined wall 11 is connected with the lower side wall 131 and a connected part of the duct side inclined wall 11 with the lower side wall 131 is formed in a curved shape. The connecting flow passage part 13 is, as a whole, inclined in a reverse direction to the inclined directions of the duct side inclined wall 11 and the frame body side inclined wall 71. Therefore, cold air which is sent from the cold air supply port "F2" to the cold air duct 10 is obliquely flowed upward along the connecting flow passage part 13 and is blown to a height of the opening 60. Then, the cold air is obliquely blown downward along the duct side inclined wall 11 and the frame body side inclined wall 71 to be sent into an inner side of the frame body 40 and the cold air is blown to the ice tray 20. Therefore, the cold air is obliquely blown downward toward the ice tray 20 by the duct side inclined wall 11 and the frame body side inclined wall 71 and is flowed in the longitudinal direction of the ice tray 20.

The frame body side inclined wall 71 and the duct side inclined wall 11 are inclined with respect to the ice tray 20. The ice making recessed parts 21A located at the closest position to the wall part 41 of the ice making recessed parts 21 provided in the ice tray 20 are located on an extended line of the duct side inclined wall 11. The duct side inclined wall 11 is inclined in a direction going downward from an obliquely upper side toward the ice making recessed parts 21A located at the most front side viewed from the wall part 41. As shown in FIG. 2, when the ice tray 20 is located at the ice making position 20A, the ice making recessed parts 21A are opened so as to face an upper side ("+Z" direction side). As shown in FIG. 7A, each of an inclination angle "θ" of the duct side inclined wall 11 and an inclination angle "θ1" of the frame body side inclined wall 71 with respect to a direction ("+Z" direction) in which the ice making recessed parts 21A are opened is a predetermined angle less than 90 degrees. The inclination angles "θ" and "θ1" may be the same as each other and, alternatively, they may be different from each other. The frame body side inclined wall 71 and the duct side inclined wall 11 structure a cold air blowing outlet 14 which is opened in an inner side face of the wall part 41 in the frame body 40.

A tip end of the duct side inclined wall 11 structuring the lower inclined wall is directed to a direction of the ice making recessed parts 21A located at the closest position to the wall part 41. Further, the cold air blowing outlet 14 which is opened between the duct side inclined wall 11 and the frame body side inclined wall 71 is located on an upper side with respect to the ice tray 20, in other words, on a side where the ice making recessed parts 21 are opened with respect to the ice tray 20, and the cold air blowing outlet 14 faces the ice making recessed parts 21A located at the closest position to the wall part 41. Therefore, cold air flowed from the cold air blowing outlet 14 is blown to the ice making recessed parts 21A located at the closest position to the wall part 41. Therefore, when water has been supplied to the ice making recessed parts 21A, the cold air is blown to the surface of the water. The cold air blown to the ice making recessed parts 21A is flowed toward the drive unit 30 along the ice tray 20. Accordingly, a flow of the cold air going from the wall part 41 side of the ice tray 20 toward the drive unit 30 side is formed and thus the cold air can be efficiently spread over the ice making recessed parts 21.

As shown in FIG. 6, a center in the width direction of the duct side inclined wall 11 is formed with a cut-out part 111 which is formed by cutting out a region corresponding to the two center divided openings 60S (in other words, the two divided openings 60S provided with the radial ribs 66 between two vertical ribs 61). Further, one groove part 112 which is formed by cutting out at a position corresponding to the vertical rib 61 provided in the opening 60 is formed on both sides with respect to the cut-out part 111. Further, a relief part (recessed part) 113 is formed in a region of a part in the width direction of a tip end of the duct side inclined wall 11. The duct side inclined wall 11 is formed so that a portion on the "+X" direction side with respect to the cut-out part 111 which is provided at its center portion is shorter than a portion on the "−X" direction side and is recessed by one stage. The recessed portion is the relief part 113. The relief part 113 is, similarly to the relief parts 482 and 483 formed in the inside frame part 46 and the projecting part 70 of the frame body 40, formed in a shape so as to avoid an interference between the ice tray 20 which is applied with and deformed by a force in the twisting direction and the cold air duct 10.

When the cold air duct 10 is to be connected with the opening 60 of the frame body 40, the vertical rib 61 is fitted to the groove part 112 formed in the duct side inclined wall 11, and a tip end of the vertical rib 61 is entered into a bottom part of the groove part 112. As a result, the tip end of the duct side inclined wall 11 is entered into an inner side of the frame body 40 through an upper side of the lower end face 63 of the opening 60. Therefore, the cold air blowing outlet 14 provided between the duct side inclined wall 11 and a tip end (lower end) of the frame body side inclined wall 71 is located on an inner side of the frame body 40. Accordingly, the cold air blowing outlet 14 can be brought close to the vicinity of the ice making recessed parts 21 provided in the ice tray 20.

The side walls 133 of the connecting flow passage part 13 are integrally formed with first arm parts 134 which are extended to both sides in the width direction ("X"-axis direction) of the duct side inclined wall 11 and are connected with side end edges of the duct side inclined wall 11. Further, the side wall 133 is integrally formed with a second arm part 135 which is protruded to the wall part 41 side ("−Y" direction side) on a lower side ("−Z" direction side) with respect to the first arm part 134. The first arm part 134 and the second arm part 135 are located on the same face as the side wall 133. As shown in FIG. 2, when the cold air duct 10 is connected with the ice making machine main body 2, the duct side inclined wall 11 is inserted into the opening 60 and the first arm parts 134 provided at both ends of the duct side inclined wall 11 are guided by inner side faces of the side plate parts 73 and disposed on the inner sides of the side plate parts 73 located on both sides in the "X"-axis direction of the opening 60. In other words, the first arm part 134 is an overlapping part which is disposed on an inner peripheral side of the opening 60 and is overlapped with the side plate part 73, and the first arm parts 134 are held by the side plate parts 73.

As shown in FIG. 6, the cold air duct 10 is formed with a connecting wall 136 which is protruded from the connecting flow passage part 13 to the wall part 41 side ("−Y" direction side) and connects lower end faces of the second arm parts 135. The connecting wall 136 is connected with the lower side wall 131 of the connecting flow passage part 13 and is protruded from the lower side wall 131 in the same direction as the second arm part 135. Engaging arm parts 137 are formed at both ends in the width direction of the connecting wall 136 so that protruding dimensions of the engaging arm parts 137 are longer than that of a center portion of the connecting wall 136. The engaging arm part 137 is provided at two positions separated from each other in the width direction ("X"-axis direction). The lower frame body 49 of the frame part 40 is formed with an engaging hole 413 at two positions corresponding to the two engaging arm parts 137.

A tip end of the engaging arm part 137 is formed with an engaging pawl 138 which is engageable with an edge of the engaging hole 413. When the cold air duct 10 is to be attached to the frame body 40, two engaging arm parts 137 are respectively inserted into a space between the two vertical ribs 61 and the engaging pawl 138 provided at the tip end of the engaging arm part 137 is engaged with the edge of the engaging hole 413. When the engaging pawls 138 are engaged with the edges of the engaging holes 413, the cold air duct 10 is set in a turnable state in the upper and lower direction with the engaging pawls 138 as a turning center. In this state, when the cold air duct 10 is turned to an upper side ("+Z" direction side), a tip end of the upper side wall 132 of the connecting flow passage part 13 is connected with an upper end face 62 of the opening 60. In this state, the cold air duct 10 is fixed to the frame body 40 by a fixing screw 74 described below.

Further, when the engaging pawl 138 is engaged with the engaging hole 413 and the cold air duct 10 is turned to an upper side, the first arm part 134 of the cold air duct 10 is inserted into the inner peripheral side of the opening 60 and is overlapped with the side plate part 73 as described above and the duct side inclined wall 11 is inserted to an upper side with respect to the lower end face 63 of the opening 60. Therefore, a connected portion of the cold air duct 10 with the opening 60 is structured so that the cold air duct 10 is entered into the inner side of the opening 60 except the connected portion of the cold air duct 10 with the upper end face 62 of the opening 60. The cold air duct 10 is contacted with an inner side face of the opening 60 in the width direction ("X"-axis direction) and an opening width of the cold air blowing outlet 14 (dimension in the "X"-axis direction) is smaller than a width in the "X"-axis direction of the frame body 40. In this embodiment, the "X"-axis direction is a direction which is perpendicular to a longitudinal direction of the ice tray 20 ("Y"-axis direction) and is perpendicular to a depth direction of the ice making recessed part 21 ("Z"-axis direction). The cold air blowing outlet 14 having the above-mentioned opening width can be disposed on an inner side of the frame body 40 and thus the cold air blowing outlet 14 can be disposed in the vicinity of the ice tray 20. Therefore, cold air can be effectively supplied to the ice tray 20. Further, the opening width of the cold air blowing outlet 14 (dimension in the "X"-axis direction) is larger than a width in the "X"-axis direction of the ice tray 20 and thus cold air can be blown to the entire ice tray 20 in the width direction.

Figure 8:
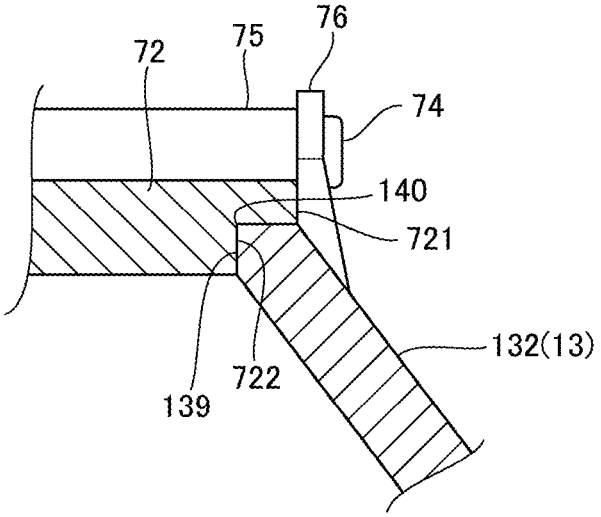
FIG. 8 is a partial enlarged view showing a connected portion of an opening of a frame body with a cold air duct.

A connected portion of the upper end face 62 of the opening 60 with the cold air duct 10 is structured so that an end face of the opening 60 and an end face of the cold air duct 10 are abutted with each other. The abutted portion is structured so that a protruded shape and a recessed shape formed in the end faces are fitted to each other. FIG. 8 is a partial enlarged view showing the connected portion of the opening 60 of the frame body 40 with the cold air duct 10 and is a partial enlarged view showing the region "B" in FIG. 7A. In this embodiment, a step part 722 is formed in a tip end face 721 of the upper plate part 72 which is an opening side end face. The step part 722 is formed in a shape so that a lower side portion of the tip end face 721 is recessed by one stage. On the other hand, an end face 139 which is a duct side end face to be abutted with the opening side end face is formed in an inversion shape to the step part 722. In other words, an edge part 140 is formed at an end part in the "+Z" direction of the end face 139, and the edge part 140 is formed in an inversion shape to the step part 722. When the cold air duct 10 is to be connected with the opening 60, the tip end of the upper side wall 132 of the cold air duct 10 is connected with the upper end face 62 of the opening 60. In this case, the step part 722 formed in the tip end face 721 which is the opening side end face is fitted to the edge part 140 formed in the end face 139 of the upper side wall 132 which is the duct side end face.

The frame body 40 and the cold air duct 10 are fixed to each other so that the upper side wall 132 and the upper end face 62 of the opening 60 are fixed to each other at one position by the fixing screw 74. In other words, an upper face of the upper plate part 72 which structures the upper end face 62 of the opening 60 is formed with a boss part 75 which is a frame body side fixing part for fixing the cold air duct 10. A screw hole which is opened to the "+Y" direction is formed in the boss part 75. On the other hand, the cold air duct 10 is formed with a duct side fixing part which is fixed to the boss part 75 at one position. The duct side fixing part is a fixing plate 76 which is stood up to the "+Z" direction from a center in the "X"-axis direction of an end face of the upper side wall 132. A center of the fixing plate 76 is formed with a screw hole and the fixing plate 76 is fixed to the boss part 75 by the fixing screw 74. When the fixing plate 76 which is a duct side fixing part is fixed to the boss part 75 which is a frame body side fixing part so that the cold air duct 10 is fixed to the frame body 40, the duct side end face 139 is connected with the frame body side inclined wall 71 which is the upper inclined wall through the upper plate part 72. Therefore, cold air supplied through the connecting flow passage part 13 is blown to the ice making recessed parts 21 of the ice tray 20 through the cold air blowing outlet 14 structured of the frame body side inclined wall 71 and the duct side inclined wall 11.

A fixed portion where the boss part 75 and the fixing plate 76 are fixed to each other by the fixing screw 74 is provided on an upper side ("+Z" direction side) with respect to the upper end face 62 of the opening 60. On the other hand, the engaged portion where the edge of the engaging hole 413 and the engaging pawl 138 are engaged with each other is provided on a lower side ("−Z" direction side) with respect to the lower end face 63 of the opening 60. In other words, the engaged portion and the fixed portion are provided so as to interpose the opening 60 therebetween. As a result, as described above, the cold air duct 10 is turned with the engaged portion as a supporting point to connect the cold air duct 10 with the opening 60 and the boss part 75 and the fixing plate 76 are abutted with each other and are fixed to each other. Therefore, the cold air duct 10 can be connected with the opening 60 by a simple operation. Further, the boss part 75 which is the frame body side fixing part is disposed on an upper side in the vertical direction ("+Z" direction) with respect to the opening 60 and thus, while one point fixing, the cold air duct 10 can be stably supported. In this embodiment, the boss part 75 and the fixing plate 76 are fixed to each other by the fixing screw 74. Therefore, the fixing can be released by detaching the fixing screw 74 and, since the engaging pawl 138 is engaged with an edge of the engaging hole 413, when engagement of the engaging pawl 138 with the engaging hole 413 is released, the cold air duct 10 can be detached from the frame body 40.

(Principal Operations and Effects in this Embodiment)

As described above, the ice making machine 1 in accordance with at least an embodiment of the present invention includes the ice making machine main body 2 and the cold air duct 10, and the opening 60 formed in the frame body 40 of the ice making machine main body 2 and the cold air supply port "F2" are connected with each other through the cold air duct 10. Therefore, according to the ice making machine 1 in accordance with at least an embodiment of the present invention, a change and the like of arrangement and/or a shape of the cold air supply port "F2" can be easily coped. Further, the cold air supply port "F2" and the opening 60 are connected with each other through the cold air duct 10 and thus cold air can be effectively supplied to an inner side of the frame body 40. Further, the cold air duct 10 is connected by utilizing the wall part 41 located on an opposite side to the drive unit 30 for turning the ice tray 20 and thus cold air can be supplied to the vicinity of the ice tray 20 in a simple structure. Therefore, ice making efficiency can be enhanced. Further, cold air is supplied from an end part in a longitudinal direction of the ice tray 20 and thus the cold air can be effectively spread over the ice tray 20.

In this embodiment, the wall part 41 is provided with the frame body side inclined wall 71 which is a cold air guide part. Therefore, cold air which is supplied through the cold air duct 10 can be guided to a side of the ice tray 20. Specifically, the frame body side inclined wall 71 is an inclined wall which is inclined with respect to a direction where the ice making recessed parts 21 provided in the ice tray 20 are opened, and the frame body side inclined wall 71 is connected with the upper end face 62 of the opening 60. Therefore, cold air which flows a far side from the ice tray 20 can be blown downward toward the ice tray 20.

The cold air duct 10 in this embodiment is provided with the duct side inclined wall 11 which faces the frame body side inclined wall 71. Therefore, cold air is obliquely blown downward between the frame body side inclined wall 71 and the duct side inclined wall 11 and the cold air is obliquely supplied downward toward the ice making recessed parts 21. Therefore, the cold air can be obliquely blown to the ice making recessed parts 21 and thus ice making efficiency can be enhanced.

In this embodiment, a tip end of the duct side inclined wall 11 is directed to a direction of the ice making recessed parts 21A located at the closest position to the wall part 41. Therefore, cold air can be blown to the ice making recessed parts 21A located at the most front side viewed from the wall part 41 side, and a flow of cold air can be made from the wall part 41 side of the ice tray 20 toward the drive unit side. Therefore, the cold air can be efficiently spread over the ice making recessed parts 21. In accordance with an embodiment of the present invention, a tip end of the duct side inclined wall 11 may be directed to a direction between the ice making recessed parts 21A located at the closest position to the wall part 41 and the wall part 41. Also in this arrangement, cold air can be blown to the ice making recessed parts 21A located at the closest to the wall part 41.

The cold air duct 10 in this embodiment is attached to the ice making machine main body 2 so that the cold air blowing outlet 14 is located with respect to the ice tray 20 on a side where the ice making recessed parts 21 are opened. As a result, the cold air blowing outlet 14 is disposed at a position where the cold air blowing outlet 14 faces water in the ice making recessed parts 21. Therefore, the cold air can be blown to the water and thus ice making efficiency can be enhanced.

The cold air duct 10 and the frame body side inclined wall 71 in this embodiment structure the cold air blowing outlet 14 whose opening width (width in the "X"-axis direction) is smaller than the width in the "X"-axis direction of the frame body 40. Therefore, the cold air blowing outlet 14 can be disposed on an inner side of the frame body 40 and the cold air blowing outlet 14 can be disposed in the vicinity of the ice tray 20. Accordingly, cold air can be effectively supplied to the ice tray 20 and ice making efficiency can be enhanced. Further, an opening width (width in the "X"-axis direction) of the cold air blowing outlet 14 is larger than the width of the ice tray 20 (width in the "X"-axis direction). Therefore, cold air can be blown to the entire ice tray 20 in the width direction.

In this embodiment, the vertical ribs 61 are formed in the opening 60 to which the cold air duct 10 is attached. Therefore, a rectification effect is obtained by the vertical ribs 61 and thus a flow of cold air can be stabilized. Further, a reinforcement effect by the vertical ribs 61 is obtained and thus, even when the opening 60 is provided, strength of the wall part 41 is secured. In accordance with an embodiment of the present invention, a direction of the rib for reinforcing the opening 60 is not limited to a vertical direction ("Z"-axis direction) and may be a lateral direction ("X"-axis direction) or a direction between the vertical direction and the lateral direction.

In this embodiment, the wall part 41 is provided with the holding hole 412 by which the turning shaft 23 of the ice tray 20 is held and the wall part 41 is formed with the ring-shaped rib 65 surrounding the holding hole 412 and the radial ribs 66 which are radially extended toward an outer side in a radial direction from the ring-shaped rib 65. Therefore, a portion where the opening 60 is provided is reinforced by the vertical ribs 61 and, in addition, a portion where the holding hole 412 is provided is reinforced by the ring-shaped rib 65 and the radial ribs 66 and thus, strength of the wall part 41 can be secured sufficiently.

In this embodiment, when the cold air duct 10 is to be connected with the opening 60, a tip end of the upper side wall 132 of the cold air duct 10 is connected with the upper end face 62 of the opening 60. In this case, the step part 722 formed at the tip end face 721 which is the opening side end face is fitted to the edge part 140 formed at the end face 139 which is the duct side end face. As described above, since fitting parts having a protruded shape and a recessed shape are provided at a connected portion where end faces are abutted, leakage of cold air from the connected part of the opening 60 with the cold air duct 10 can be restrained. In accordance with an embodiment of the present invention, it may be structured that a step part is formed in the duct side end face and a protruded part is formed in the opening side end face.

In this embodiment, a portion of the opening 60 except the upper end face 62 is structured so that the cold air duct 10 is entered into an inner peripheral side of the opening 60, and the faces of the cold air duct 10 are provided with the overlapping parts which are overlapped with the wall surrounding the opening 60 (side plate parts 73 and lateral rib 64). Therefore, leakage of cold air from the connected part of the opening 60 with the cold air duct 10 is restrained. In accordance with an embodiment of the present invention, the overlapping part may be provided so that a tube shaped portion surrounding the opening 60 is inserted into an inner peripheral side of the cold air duct 10.

In this embodiment, the cold air duct 10 is provided with the engaging arm parts 137 protruding toward the wall part 41. Further, engaged parts (edges of the engaging holes 413) are formed at a lower end of the wall part 41. Therefore, the cold air duct 10 is connected with the opening 60 so that the engaging pawls 138 formed at the tip ends of the engaging arm parts 137 are engaged with the engaging holes 413 and that the cold air duct 10 is turned to an upper side with the engaged portion located at the lower end of the wall part 41 as a turning center. Accordingly, the cold air duct 10 can be connected with the opening 60 by a simple operation. Further, in this case, an end face of the upper end face 62 of the opening 60 and an end face of the upper side wall 132 of the cold air duct 10 are abutted and connected with each other, and the connected portion is fixed by the fixing screw 74 at one position. Therefore, a gap space between the cold air duct 10 and the frame body 40 can be reduced. Specifically, the engaging arm part 137 of the cold air duct 10 is provided at both ends in the width direction ("X"-axis direction) of the connecting flow passage part 13 and, on the other hand, the fixing plate 76 is provided at the center in the "X"-axis direction of the end face of the upper side wall 132. Therefore, when the engaging pawl 138 formed at the tip end of the engaging arm part 137 is engaged with the engaging hole 413 at the positions of both ends in the width direction ("X"-axis direction) of the connecting flow passage part 13 and, when the fixing plate 76 is fixed to the boss part 75 at the center position in the "X"-axis direction, the cold air duct 10 is fixed to the wall part 41 at three positions. Accordingly, the step part 722 formed at the tip end face 721 of the upper plate part 72 which is the opening side end face and the end face 139 which is the duct side end face can be abutted with each other in a stable state and occurrence of a gap space therebetween can be suppressed. For example, in a case that the cold air duct 10 is fixed to the wall part 41 at four positions by providing the fixing plate 76 at both end positions in the "X"-axis direction, distortion may be occurred in the upper side wall 132 due to the fixing plates 76 fixed at both end positions in the "X"-axis direction. In this case, a gap space may be occurred between the tip end face 721 of the upper plate part 72 which is the opening side end face and the end face 139 that is the duct side end face and thus leakage of cold air may be occurred. However, in this embodiment, the connected portion of the upper end face 62 of the opening 60 with the upper side wall 132 of the cold air duct 10 is fixed at one position by the fixing screw 74 and thus, a gap space between the cold air duct 10 and the upper plate part 72 can be reduced to suppress leakage of the cold air.

In this embodiment, the fixed portion where the boss part 75 and the fixing plate 76 are fixed to each other by the fixing screw 74 and the engaged portion where the edge of the engaging hole 413 and the engaging pawl 138 are engaged with each other are provided on opposite sides so as to interpose the opening 60 therebetween. Therefore, when the cold air duct 10 is turned with the engaged portion as a supporting point and the boss part 75 and the fixing plate 76 are abutted with and fixed to each other, the cold air duct 10 is connected with the opening 60. Therefore, the cold air duct 10 can be connected with the opening 60 by a simple operation. In accordance with an embodiment of the present invention, the engaged portion and the fixed portion may be provided on both sides in the width direction ("X"-axis direction) of the opening 60 when it is structured so that leakage of the cold air is suppressed.

In this embodiment, the boss part 75 which is a frame body side fixing part is provided on an upper side in the vertical direction with respect to the opening 60 and thus, while fixing at one position, the cold air duct 10 can be stably supported. Alternatively, the frame body side fixing part (boss part 75) may be provided on a lateral side (in other words, "+X" direction side or "−X" direction side) with respect to the opening 60. In a case that a frame body side fixing part (boss part 75) is provided on a lateral side with respect to the opening 60, the frame body side fixing part is desirable to be provided on an upper side ("+Z" direction side) with respect to the center of the opening 60. When the fixed portion by the fixing screw 74 is provided in an upper half region of the connected portion of the opening 60 with the cold air duct 10, the cold air duct 10 can be stably supported while fixed at one point.

In this embodiment, the engaging arm part 137 of the cold air duct 10 is engaged with the frame body 40 at a separated position from the opening 60. Therefore, the engagement structure can be provided at a position where an air passage of cold air is not affected.

In this embodiment, in a state that the ice tray 20 is turned by a predetermined angle from the ice making position 20A, the projection 24 provided in the ice tray 20 and the abutting part 411 provided in the frame body 40 are abutted with each other and a force in a twisting direction is applied to the ice tray 20. Therefore, the frame body 40 is formed with the relief parts 481 and 482 for avoiding an interference with the ice tray 20 which has been twisted and deformed. Further, the duct side inclined wall 11 of the cold air duct 10 is formed with the relief part (recessed part) 113 which is formed by cutting out a position corresponding to the relief part 482 provided in the projecting part 70 of the frame body 40. Therefore, an interference between the cold air duct 10 and the ice tray 20 can be prevented.

Modified Embodiments

In the embodiment described above, the duct side inclined wall 11 is directed in a direction to the ice making recessed part 21A located at the closest position to the wall part 41, or in a direction between the ice making recessed part 21A located at the closest position to the wall part 41 and wall part 41. However, the duct side inclined wall 11 may be directed in a direction to the ice making recessed part 21 other than the ice making recessed part 21A located at the closest position to the wall part 41. Even in this structure, cold air can be made flow to the ice making recessed parts 21. Therefore, cold air can be effectively supplied to the ice making recessed parts 21 of the ice tray 20 and thus ice making efficiency can be enhanced.

In the embodiment described above, the cold air supply port "F2" is located on a lower side ("−Z" direction side) with respect to the opening 60 provided in the wall part 41 and thus, the connecting flow passage part 13 of the cold air duct 10 is inclined in a reverse direction to the inclined direction of the inclined flow passage part 11. However, a direction of the connecting flow passage part 13 may be appropriately changed depending on a position of the cold air supply port "F2". In this case, the position of the opening 60 and the inclined direction of the inclined flow passage part 11 are not changed and a shape of the connecting flow passage part 13 is changed. For example, in a case that the cold air supply port "F2" is located at the same height as the opening 60, a cold air duct 10 provided with a connecting flow passage part 13 which is extended in a substantially horizontal direction may be used. Further, in a case that the cold air supply port "F2" is located on an upper side ("+Z" direction side) with respect to the opening 60, a cold air duct 10 may be used which is provided with a connecting flow passage part 13 inclined downward from the cold air supply port "F2" to the opening 60. Further, in a case that the cold air supply port "F2" is provided at a position displaced on the "+X" direction side or the "−X" direction side with respect to the opening 60, a cold air duct 10 may be used which is provided with a connecting flow passage part 13 facing a direction between the "Y"-axis direction and the "X"-axis direction. According to these structures, the cold air supply port "F2" and the opening 60 can be connected with each other and thus, similarly to the embodiment described above, cold air can be effectively supplied to the ice making recessed parts 21 of the ice tray 20.

In the embodiment described above, the opening widths (width in the "X"-axis direction) of the opening 60 and the cold air blowing outlet 14 are larger than the width in the "X"-axis direction of the ice tray 20. However, the opening widths (width in the "X"-axis direction) of the opening 60 and the cold air blowing outlet 14 may be smaller than the width in the "X"-axis direction of the ice tray 20. Even when the opening width of the cold air blowing outlet 14 is narrower than the width of the ice tray 20, cold air is spread to both sides in the width direction ("X"-axis direction) and thus the cold air can be supplied to a portion separated from a front face of the cold air blowing outlet 14.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making machine which is to be disposed in an ice making chamber provided with a cold air supply port to which cold air is supplied, the cold air being used to freeze water supplied to an ice tray to make ice, the ice making machine comprising:

the ice tray comprising a plurality of the ice making recessed parts which are arranged in a longitudinal direction of the ice tray;

a drive unit which is provided on a first end side in the longitudinal direction of the ice tray and is structured to turn the ice tray;

a frame body which supports the ice tray and the drive unit, the frame body comprising a wall part which is provided in the frame body on a second end side in the longitudinal direction of the ice tray so as to face the drive unit on an opposite side to the first end side;

and a cold air duct structured to connect an opening formed in the frame body with the cold air supply port;

wherein the wall part comprises:

the opening through which the cold air is sent to the ice tray through the cold air duct;

a cold air guide part which is structured to guide the cold air to the ice tray through the opening, a rib which is integrally formed with the cold air guide part so as to divide the opening; and a holding hole which turnably holds a turning shaft protruded from the ice tray; wherein the rib comprises;

a vertical rib which is integrally formed with the cold air guide part and divides the opening in a width direction of the ice tray;

a ring-shaped rib surrounding the holding hole, and a radial rib which is radially extended from the ring-shaped rib and is integrally formed with the vertical rib and the ring-shaped rib; and wherein the cold air is sent from the cold air duct to the ice tray through the opening formed of the cold air guide part and the vertical rib which are formed in the wall part of the frame body.

2. The ice making machine according to claim 1, wherein the cold air guide part is an inclined wall which is inclined with respect to a direction in which the plurality of the ice making recessed parts provided in the ice tray is opened.

3. The ice making machine according to claim 2, wherein the inclined wall is a frame body side inclined wall which is connected with an edge of the opening on a side of the ice tray.

4. The ice making machine according to claim 3, wherein the cold air duct comprises a duct side inclined wall which faces the frame body side inclined wall.

5. The ice making machine according to claim 4, wherein a tip end of the duct side inclined wall is directed to a direction of one of the plurality of the ice making recessed parts which is located at a closest position to the wall part on the second end side in the longitudinal direction of the ice tray, or to a direction between the one of the plurality of the ice making recessed parts which is located at the closest position to the wall part on the second end side in the longitudinal direction of the ice tray and the wall part.

6. The ice making machine according to claim 2, wherein the cold air guide part and the cold air duct structure a cold air blowing outlet for flowing the cold air toward the ice tray, and the cold air blowing outlet is located with respect to the ice tray on a side where the plurality of the ice making recessed parts is opened.

7. The ice making machine according to claim 6, wherein a dimension of the cold air blowing outlet in a direction perpendicular to the longitudinal direction of the ice tray and a depth direction of each of the plurality of the ice making recessed parts is smaller than that of the frame body.

8. The ice making machine according to claim 1, wherein the cold air guide part formed in the wall part is a frame body side inclined wall which is inclined with respect to a direction where the plurality of the ice making recessed parts provided in the ice tray is opened, and the cold air duct comprises a duct side inclined wall which is inclined with respect to the direction where the plurality of the ice making recessed parts is opened so as to face the frame body side inclined wall.

9. The ice making machine according to claim 1, wherein the frame body side inclined wall is an upper inclined wall which structures an upper side inclined wall for a cold air blowing outlet through which the cold air is flowed toward the ice tray, the duct side inclined wall is a lower inclined wall which structures a lower side inclined wall for the cold air blowing outlet, the vertical rib comprises a plurality of the vertical ribs which divide the opening in the width direction of the ice tray, and the cold air blowing outlet is divided in a plurality of divided openings by the upper inclined wall, the lower inclined wall and the plurality of the vertical ribs.

10. The ice making machine according to claim 9, wherein one of the plurality of the vertical ribs is formed in a flat plate shape extending in an upper and lower direction so as to be integrally formed and connected with the upper inclined wall, the lower inclined wall is formed with a groove and a cut-out part to which the plurality of the vertical ribs is fitted, and the plurality of the vertical ribs is fitted to the groove and the cut-out part of the lower inclined wall so that the cold air blowing outlet is divided and thereby the plurality of the divided openings is structured.

11. The ice making machine according to claim 10, wherein the plurality of the vertical ribs and the radial rib are disposed in the cut-out part of the lower inclined wall.

12. The ice making machine according to claim 1, wherein the frame body comprises an opening side end face which is abutted with a duct side end face of the cold air duct and a frame body side fixing part which is disposed on an outer peripheral side of the opening side end face, and the cold air duct comprises a duct side fixing part which is fixed to the frame body side fixing part.

13. The ice making machine according to claim 12, wherein a step part is formed in one of the duct side end face and the opening side end face, and an inversion shape which a surface of the step part is fitted is formed in an other of the duct side end face and the opening side end face.

14. The ice making machine according to claim 12, wherein the cold air duct comprises an overlapping part which is disposed on an inner peripheral side or an outer peripheral side of the wall part surrounding the opening and is overlapped with the wall part.

15. The ice making machine according to claim 12, wherein the frame body side fixing part is located on an upper side in a vertical direction with respect to a center of the opening.

16. The ice making machine according to claim 12, wherein one of the cold air duct and the wall part comprises an engaging arm part which is protruded toward an other of the cold air duct and the wall part, and the other of the cold air duct and the wall part comprises an engaged part which is capable of engaging with an engaging pawl provided at a tip end of the engaging arm part.

17. The ice making machine according to claim 16, wherein the frame body side fixing part is provided on an opposite side to an engaged position of the engaged part with the engaging pawl with respect to the opening.

18. The ice making machine according to claim 16, wherein the engaging arm part is provided in the cold air duct, and the engaged part is provided at a position different from the opening.

19. The ice making machine according to claim 12, wherein the cold air duct comprises a connecting flow passage part having a lower side wall, an upper side wall and side walls which connect both ends in a width direction of the lower side wall and the upper side wall with each other, and the duct side end face is provided at a tip end of the upper side wall and the duct side fixing part is provided in a tip end portion of the upper side wall.

20. The ice making machine according to claim 19, wherein the cold air guide part formed in the frame body is an upper inclined wall structuring an upper side inclined wall for a cold air blowing outlet structured to flow cold air toward the ice tray, the upper inclined wall being inclined with respect to a direction where an ice making recessed part provided in the ice tray is opened, the cold air duct comprises a duct side inclined wall which is a lower inclined wall facing the upper inclined wall, the lower inclined wall being inclined with respect to the direction where the ice making recessed part is opened, and when the duct side fixing part is fixed to the frame body side fixing part and thereby the cold air duct is fixed to the frame body, the duct side end face is connected with the upper inclined wall and the cold air blowing outlet is structured by the upper inclined wall and the duct side inclined wall.

21. The ice making machine according to claim 1, wherein the drive unit is structured to turn the ice tray by a predetermined angle from an ice making position, the frame body comprises an abutting part which is abutted with a projection provided in the ice tray to apply a force in a twisting direction to the ice tray in a state that the ice tray has been turned by the predetermined angle, and each of the frame body and the cold air duct is formed with a relief part which avoids an interference with the ice tray in the state that the ice tray has been turned by the predetermined angle.

* * * * *